United States Patent [19]

Invernati

[11] 4,044,646

[45] Aug. 30, 1977

[54] SUPPORTING AND PIVOT DEVICE MADE OF PLASTIC FOR KEYS OF PIANOS, ELECTRONIC ORGANS AND THE LIKE

[75] Inventor: Carlo Invernati, Sirolo, Italy

[73] Assignee: Danyel S.A.S., Sirola (Ancona), Italy

[21] Appl. No.: 670,982

[22] Filed: Mar. 26, 1976

[30] Foreign Application Priority Data

Apr. 1, 1975 Italy ..... 609/75

[51] Int. Cl.[2] ..... G10C 3/12

[52] U.S. Cl. ..... 84/435

[58] Field of Search ..... 84/435, 434, 433

[56] References Cited

U.S. PATENT DOCUMENTS 2,530,832 11/1950 Martin ..... 84/434

3,654,831 4/1972 Grilli et al. ..... 84/435

FOREIGN PATENT DOCUMENTS 555,973 2/1957 Italy ..... 84/435

*Primary Examiner*—Stephen J. Tomsky

*Attorney, Agent, or Firm*—Wigman & Cohen

[57] ABSTRACT

A supporting and pivot device for use in a keyboard of a musical instrument. The device is preferably made of plastic and is wedge-shaped having a pair of adjacent slots, one of said slots being adapted to securely receive a pin by virtue of the resilient deflection of one wall of the receiving slot towards the other slot. The lever of the keyboard is pivotably secured to the support frame through the device and secured pin.

5 Claims, 5 Drawing Figures

SUPPORTING AND PIVOT DEVICE MADE OF PLASTIC FOR KEYS OF PIANOS, ELECTRONIC ORGANS AND THE LIKE

BACKGROUND OF THE INVENTION

The present invention relates to keyboards for musical instruments and more particutarly to a supporting and pivot device made of plastic. The pivot device has sufficient strength and is capable of slight elastic deformation. It is designed to support the respective key body with the interposition of a lever member so as to articulate said key about a pivot transverse pin or rod supported by the stationary frame of the keyboard so as to permit that said key can be pressed down or struck by a finger against the effect of a return spring, rotating about said pin with a very easy, noiseless, steady and springing-up movement which is perfect in all respects.

BRIEF DESCRIPTION OF THE DRAWING

These and other characteristics and advantages of the present invention will be hereinafter described in more detail with reference to an embodiment thereof shown in the accompanying drawing, in which.

DESCRIPTION OF THE PREFERRED EMBODIMENT

Figure 1:
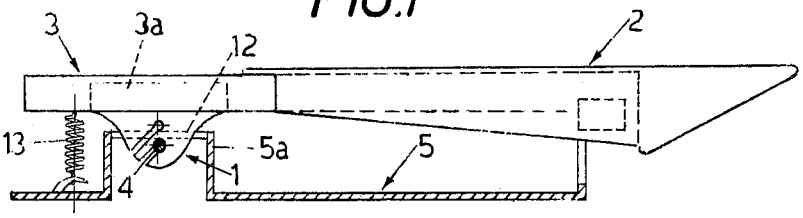
FIG. 1 is a diagrammatic longitudinal side view of a key connected to its supporting lever which is made integral with the device of the invention and pivotally mounted on a pivot pin or rod supported by the stationary frame of the keyboard which has been partially cut away.
Figure 2:
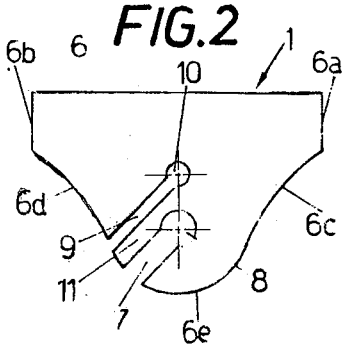
FIGS. 2 and 3 are a longitudinal side view and a perspective view respectively of the device of the invention.
Figure 3:
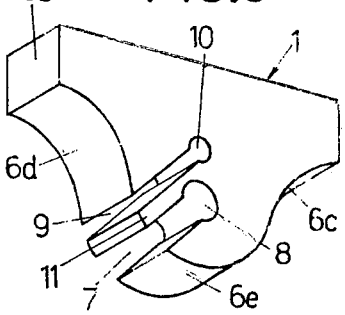

Now referring to the drawing, the device of this invention is generally designated with the reference numeral 1, while 2 is a conventional key body and 3 is the metal lever which will be made integral with the key 2 and with the device 1, which in turn will be pivotally connected with a transverse pivot pin or a common transverse rod 4 carried by the stationary frame 5 of the keyboard of a piano, electronic organ or other similar musical instrument.

FIGS. 2 to 5 show the supporting and pivot device 1 in an enlarged scale. Pivot device 1 is made of plastic of a sufficient strength and which is slightly elastically deformable. The device 1 is shaped as a wedge which has a upper flat surface 6, while its front and rear surfaces present upper vertical parallel portions **6*a* and 6*b* and lower front and rear curved portions 6*c* and 6*d* radiused one with the other to merge at their lower end portion 6*e*. Through the rear curved portion 6*d* of the rear surface of the device 1 is arranged a slot 7 extending upwardly and forwardly and ending into a cylindrical hole 8 having the axis parallel to that of the pin 4 and of a diameter substantially equal to that of said pin 4 which is designed to be received into said hole 8. The width of said slot 7 is slightly smaller than said diameter. Adjacent to the main slot 7 and hole 8 there is a second slot 9 ending into a hole 10 which together with the slot 7 and hole 8 define an interposed flexible limb or tongue 11 for the purpose of imparting to one of the side walls of the slot 7** increased elastic deformability.

The keys 2 are "per se" conventional so that the device of the invention can be applied either to the white or the black keys of any piano or the like. The lever 3 is made of metal and is so shaped to form a front portion to be connected, in any suitable manner, with the body of the key 2, as, for instance, by means of adhesives, rivets and the like, while at its central portion a prismatic inner recess **3*a* is provided, open at its lower part to receive and retain the upper portion of the device 1, which will be fixed to said lever 3 by any suitable means. The frame 5, preferably made of metal, has a known form and presents a hollow upwardly extending transverse rib 5*a* supporting the pins 4 or a common pivot rod, said rib 5*a* being provided with orifices 12 through which can pass and freely rotate the lower portion of each device 1, as the pin or rod 4 is received into the respective hole 8. The rear end of the lever 3 is connected to a helical compression spring 13, which in turn is anchored at its other end to the frame 5 and designed to return the respective key 2** in its inoperative position after having been struck or pressed down by a finger.

Figure 4:
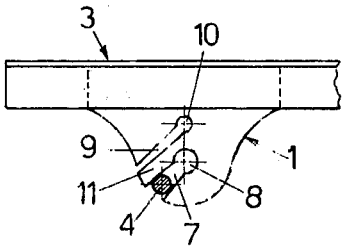
FIGS. 4 and 5 show a longitudinal side view of the detail of the said supporting and pivot device connected with said supporting lever while being assembled with the pivot pin and as said assembly has been completed.
Figure 5:
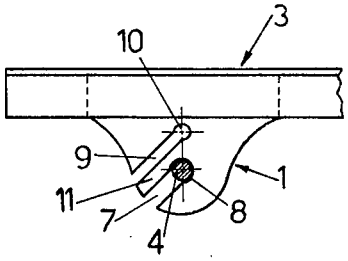

The aforesaid elements are connected to each other, firstly connecting a key 2 with the respective lever 3 and then inserting the device 1 into the seat **3*a* of said lever and fixing this latter therein with any suitable means. Then said assembled components are pivotally mounted on the respective pin 4 approaching the device 1 so as to bring the entrance of the slot 7 before the said pin 4 and pushing the key against said pin 4 so as to force said pin 4 to enter the slot 7, causing the side walls of this latter to move away one from the other, owing to the deformability of the material of which the device 1 has been made and further owing to the presence of the adjacent slot 9 enabling the side walls of this latter to approach one to the other as can be seen in FIG. 4. As the pin enters the hole 8 it is snap received therein, since the side walls of the slot 7 and the limb 11 elastically take again their starting unstressed condition so that the key remains pivotally connected to the respective pivot pin 4 and can be noiseless and easy depressed during the playing, the spring 13 thence returning the key 2** in its inoperative position according to a known solution. Therefore the device of the invention enables to obtain a perfect and improved articulation of the keys of a piano or other similar musical instrument, while the other parts thereof are not modified.

What we claim is:

1. A supporting and pivot device to be connected to the lever carrying a key of keyboard of a piano, electronic organ or the like, to be pivotally connected with a transverse pivot pin or rod supported by the stationary frame of said keyboard and where the key is associated with a return spring, characterized by the fact that the device comprises a body made of plastic having a sufficient strength and capable of a slight elastic deformation, said body being shaped substantially as a wedge having an upper flat surface designed to be connected with said lever, and curved front and rear surface portions which merge at their respective lower portion, one of the curved rear surface portions of said body includes a first transverse slot extending upwardly and inwardly where it terminates at a central cylindrical hole, the axis of said hole being parallel to the axis of the pivot pin and having substantially the same diameter as that of said pin, said slot having a width slightly smaller than the diameter of said pin, a second slot which is adjacent to and parallel with said first named slot which cooperates with said first slot to increase the elastic deformability of one of the side walls of said first slot when said pivot pin is received into said first slot where it is secured within said hole associated with said first slot.

2. A device according to claim 1, wherein the lever is made of metal and comprises a first front portion to be connected with the key, a central portion provided with an inner recess designed to receive and to hold the upper portion of the device, and a third rear portion to which a helical compression spring is anchored at one end, the other end being connected to the frame, said spring being designed to return the respective key to its inoperative position after having been depressed.

3. A device according to claim 1 wherein each of said slots have openings at one end which communicates with the curved surface of said device, the opposite end of each slot being a bore hole of a diameter slightly larger than the slot width, the axis of each bore being aligned in a substantially perpendicular orientation with respect to the plane defined by the upper surface of the device.

4. A device according to claim 3, wherein the width of the slot for receiving said pin is larger than the width of the adjacent slot.

5. A device according to claim 1, wherein said first and second named slots each have a transverse opening in a curved surface of said device, the material thickness between said openings being predetermined to permit the thickness to deflect into the second named slot when said pin is inserted into said first named slot, said thickness returning to its normal position after said pin is received in said hole at the end of said first named slot to prevent said pin from inadvertantly coming out.

* * * * *